US009074790B2

(12) United States Patent
Hultmark et al.

(10) Patent No.: US 9,074,790 B2
(45) Date of Patent: Jul. 7, 2015

(54) PLENUM BOX

(75) Inventors: Goran Hultmark, Vastra Frolunda (SE); Robert Salomonsson, Malmo (SE); Martin Jespersen, Copenhagen V (DE); Anders Vorre, Lynge (DE)

(73) Assignee: Lindab AB, Bastad (SE)

( * ) Notice: Subject to any disclaimer, the term of this patent is extended or adjusted under 35 U.S.C. 154(b) by 1129 days.

(21) Appl. No.: 12/999,071

(22) PCT Filed: Jul. 8, 2009

(86) PCT No.: PCT/SE2009/050882
§ 371 (c)(1),
(2), (4) Date: Feb. 16, 2011

(87) PCT Pub. No.: WO2010/005386
PCT Pub. Date: Jan. 14, 2010

(65) Prior Publication Data

US 2011/0263194 A1 Oct. 27, 2011

(30) Foreign Application Priority Data

Jul. 10, 2008 (SE) ..... 0801663-6

(51) Int. Cl.
*F24F 7/00* (2006.01)
*F24F 13/10* (2006.01)
(Continued)

(52) U.S. Cl.
CPC ..... *F24F 13/10* (2013.01); *F24F 11/043* (2013.01); *F24F 13/068* (2013.01)

(58) Field of Classification Search
CPC ..... F24F 13/068; F24F 13/062; F24F 13/06; F24F 13/10; F24F 13/12; F24F 3/0522; F24F 11/043
USPC ..... 454/247, 292, 296, 298, 333, 334, 265
See application file for complete search history.

(56) References Cited

U.S. PATENT DOCUMENTS 1,319,526 A * 10/1919 Hauser ..... 454/323
2,718,840 A * 9/1955 Lyman ..... 454/256
(Continued)

FOREIGN PATENT DOCUMENTS

GB 1226089 3/1971
GB 2241573 9/1991
(Continued)

*Primary Examiner* — Steven B McAllister
*Assistant Examiner* — Jonathan Cotov
(74) *Attorney, Agent, or Firm* — Tarolli, Sundheim, Covell & Tummino LLP

(57) ABSTRACT

The invention relates to a plenum box (1*a*, 1 *b*) configured for use in a ventilation system (2) with flowing air in order to be able to quickly regulate flows between the ventilation system (2) and a room. The plenum box (1) comprises a pressure distribution pipe (4) which is disposed in an inlet (3) to the plenum box (1) and which itself comprises a regulating damper (5), and an outlet (6*a*, 6*b*). The inlet (3) is configured to have an air flow (7) passing through it. The pressure distribution pipe (4) extends inside the plenum box (1*a*, 1*b*) from the inlet (3), and the surface of the pressure distribution pipe (4) has perforations (8) which allow the air flow (7) to pass through them between the inside (9) and outside (10) of the pressure distribution pipe (4). The regulating damper (5) is disposed adjustably in the axial direction (11) inside the pressure distribution pipe (4) whereby the total aperture cross-section (12) of the perforations (8) per unit length varies in the axial direction (11) of the pressure distribution pipe (4).

19 Claims, 1 Drawing Sheet

(51) Int. Cl.
*F24F 11/04* (2006.01)
*F24F 13/068* (2006.01)

(56) References Cited

U.S. PATENT DOCUMENTS

| | | | | | |
|---|---|---|---|---|---|
| 2,720,150 | A | * | 10/1955 | Lyman | 454/265 |
| 2,720,151 | A | * | 10/1955 | Kreuttner | 454/265 |
| 2,749,831 | A | * | 6/1956 | Argentieri et al. | 454/265 |
| 2,791,170 | A | * | 5/1957 | Phillips et al. | 454/299 |
| 2,872,859 | A | * | 2/1959 | Kennedy | 454/263 |
| 2,896,849 | A | * | 7/1959 | Argentieri et al. | 236/13 |
| 3,004,348 | A | * | 10/1961 | Gustaffson | 34/114 |
| 3,537,380 | A | * | 11/1970 | Newell et al. | 454/256 |
| 3,895,449 | A | * | 7/1975 | Chance et al. | 34/638 |
| 4,009,647 | A | * | 3/1977 | Howorth | 454/187 |
| 4,027,407 | A | * | 6/1977 | Kiss | 37/321 |
| 4,061,082 | A | * | 12/1977 | Shuler | 454/298 |
| 4,065,966 | A | * | 1/1978 | Meeks, Jr. | 73/861.76 |
| 4,181,253 | A | * | 1/1980 | Barlow | 236/49.2 |
| 4,397,223 | A | * | 8/1983 | Maxson | 454/255 |
| 4,548,068 | A | * | 10/1985 | Gualtieri et al. | 73/40.7 |
| 4,616,559 | A | * | 10/1986 | Barlow | 454/298 |
| 4,796,803 | A | * | 1/1989 | Kelley | 236/49.4 |
| 5,033,362 | A | * | 7/1991 | Huckestein | 454/322 |
| 5,058,490 | A | * | 10/1991 | Sodec et al. | 454/290 |
| 5,099,754 | A | * | 3/1992 | Griepentrog | 454/298 |
| 5,333,835 | A | * | 8/1994 | Smith et al. | 251/129.12 |
| 6,019,677 | A | * | 2/2000 | Demster | 454/290 |
| 6,527,194 | B1 | * | 3/2003 | Burke | 236/49.3 |
| 6,817,941 | B1 | * | 11/2004 | Gatov | 454/187 |
| 7,147,203 | B2 | * | 12/2006 | Terrell | 251/121 |
| 2004/0089007 | A1 | * | 5/2004 | Umebayashi et al. | 62/244 |
| 2007/0015455 | A1 | * | 1/2007 | Knight et al. | 454/292 |

FOREIGN PATENT DOCUMENTS

| | | |
|---|---|---|
| JP | 8042882 | 2/1996 |
| SE | 508425 | 10/1998 |
| SE | 523948 | 6/2004 |

* cited by examiner

PLENUM BOX

FIELD OF THE INVENTION

The present invention relates to a plenum box configured for use in a ventilation system.

BACKGROUND TO THE INVENTION

Plenum boxes comprising pressure distribution pipes in which the pressure distribution pipe is configured to receive an incoming air flow from a connected ventilation system are known. It is also known that the pressure distribution pipe may comprise a regulating damper which can be regulated in such a way that the resulting flow of air into the plenum box is linear. Prior art uses rotary dampers in pressure distribution pipes. To achieve low noise values, such dampers are traditionally perforated. A problem with such dampers is that they do not entirely shut off an air flow in the closed position, with the result that there is always a certain flow of air into the plenum box. A further problem of prior art is being able to effect quick and sudden adjustments of a flow in the ventilation system, e.g. if a sudden pressure drop in the system occurs or is desired to occur. In traditional plenum box technology it is usual for there to be in a plenum box a fixed rotary damper made of, for example, perforated sheetmetal with, for example, a 50% aperture cross-section, disposed inside the plenum box above the outlet. This has been necessary in order to achieve uniform spread and distribution of the air flow downwards in the delivery facility, resulting in an unoptimised spread of air flow into the room. A disadvantage which has occurred with this fixed position of a rotary damper above the outlet is that it has made it difficult, and in many cases even impossible, to clean inside the pressure distribution pipe easily when the plenum box is opened.

SUMMARY OF THE INVENTION

An object of the present invention is to propose a plenum box which can be connected to a ventilation system and which makes it possible to quickly regulate air inflow/outflow into/from the plenum box and to overcome the problems described above.

A further object of the invention is to propose a device which is cost-effective as compared with traditional technology and which is easy to construct, enabling optimisation of cost and time.

The aforesaid and other objects are achieved according to the invention by the device described in the introduction being provided with the features indicated in claim 1.

An advantage achieved with a device according to claim 1 comprises the possibility of regulating in such a way as to effect rapid increase or decrease of air flow between a ventilation system and a room or space as compared with prior art, and also relatively noiselessly.

Preferred embodiments of the device according to the invention are further provided with the features indicated in subclaims 2-18.

According to an embodiment of the invention, the perforations are disposed in the surface of the pressure distribution pipe in such a way that their total aperture cross-section increases in the axial direction into the plenum box from the inlet. This means that the air volume entering the plenum box from the ventilation system can therefore increase at a faster rate as compared with traditional technology in which pressure distribution pipes have a constant aperture cross-section in the axial direction.

According to a further embodiment of the invention, the number of perforations in the surface of the pressure distribution pipe increases in the axial direction into the plenum box from the inlet. This makes it possible for the perforations to be of one type or shape of size. Perforations increasing in number per unit length from the inlet result in the total aperture cross-section increasing in said direction.

According to a further embodiment of the invention, some of the perforations are of a first perforation type with a specific first aperture cross-section and some of them are of a second perforation type with a specific second aperture cross-section. There are also perforations of a third perforation type with a specific third aperture cross-section which differs both from the specific first and from the specific second aperture cross-section. This makes it possible to reduce the number of holes which have to be made in the pressure distribution pipe for achieving an increase in the aperture cross-section in the axial direction of the pressure distribution pipe.

According to a further embodiment of the invention, perforations of the first perforation type are disposed in a first section, perforations of the second perforation type are disposed in a second section and perforations of the third perforation type are disposed in a third section, the first and third sections being disposed each on their respective side of the second section in the axial direction along the pressure distribution pipe. The first section is also disposed closer to the inlet than the second and third sections in the axial direction along the pressure distribution pipe into the plenum box from the inlet. This makes it possible for the respective sections to be manufactured separately and be subsequently fitted together during the assembly of the plenum box. This makes customised manufacture possible to meet particular customer requirements as to how the throughflow for each section through the pressure distribution pipe into the plenum box is to be effected.

According to a further embodiment of the invention, the first section has for a unit length a total aperture cross-section which is less than a total aperture cross-section for a corresponding unit length for the second section. Also, the third section has a total aperture cross-section for a unit length which is greater than the total aperture cross-section for a corresponding unit length of the first and of the second section. This means that the respective perforation types have relative to one another a specific aperture cross-section which increases in the axial direction of the pressure distribution pipe.

According to a further embodiment of the invention, the total aperture cross-section in the first section increases linearly in the axial direction along the pressure distribution pipe into the plenum box from the inlet. Also, the total aperture cross-section in the second section increases exponentially in the axial direction along the pressure distribution pipe into the plenum box from the inlet. And then the total aperture cross-section in the third section increases linearly in the axial direction along the pressure distribution pipe into the plenum box from the inlet. The fact that the second section increases exponentially helps to provide a so-called gentle transition of aperture cross-section in the axial direction in the pressure distribution pipe for flow of air through it. This is because there is thus no so-called step-like increase or decrease in the air flow where the aperture cross-section increases or decreases.

According to a further embodiment of the invention, the regulating damper is cone-shaped with a narrowed end and is disposed in the pressure distribution pipe with the narrowed end pointing along the centreline through the pressure distribution pipe outwards from the plenum box through the inlet. The centreline coincides with the axial direction of the pressure distribution pipe.

According to a further embodiment of the invention, the regulating damper is configured to angle an incoming air flow from the ventilation system in through the inlet towards the perforations. The fact that the regulating damper is cone-shaped means that the air flow is directed towards the inside of the pressure distribution pipe so that it can pass through the perforations in the pressure distribution pipe.

According to a further embodiment of the invention, the regulating damper is connected by a regulating element against the base portion of the regulating damper to a regulating means for the plenum box which is configured to regulate the position of the regulating damper in the axial direction inside the pressure distribution pipe. The regulating means may communicate with a central control device for the ventilation system so that the position of the regulating damper in the pressure distribution pipe can be regulated with respect to pressure, temperature and air flow. This is effected both in relation to itself and in relation to other units which communicate with the ventilation system. This makes it possible to regulate and control how air is moved inside the ventilation system to and between the various units.

According to a further embodiment of the invention, the control means is a motor, preferably an actuator, configured to regulate in a continuous movement the position of the regulating damper in the axial direction inside the pressure distribution pipe. The regulating element is a rod-like element which has its one end connected to the regulating means. The regulating means moves in a continuous movement in either direction so that the desired direction of movement can be applied to the regulating damper inside the pressure distribution pipe.

According to a further embodiment of the invention, the regulating damper is configured in the pressure distribution pipe in such a way that when the regulating damper is in position at the inlet the inlet is closed by the regulating damper so that no throughflow of air from the ventilation system into the plenum box can take place. The result is an effective way of closing the inlet and thereby making it possible to maintain a desired pressure in the ventilation system without so-called "leakage". Having no leakage in the ventilation system is an effective way of optimising the transfer and control of air inside the ventilation system.

According to a further embodiment of the invention, the regulating damper is detachably connected to the regulating element in such a way that when the plenum box is opened the regulating damper can be released and taken out of and away from the pressure distribution pipe. This makes it possible to clean inside the pressure distribution pipe in order to remove particles, dust and the like. According to a variant, the regulating element may be detachably connected to the regulating means, thereby achieving a similar effect of being able to take the regulating damper out of and away from the pressure distribution pipe.

According to a further embodiment of the invention, the periphery of the regulating damper which is adjacent to the inside of the pressure distribution pipe is provided with soft material, e.g. a fibre mat. This soft material has two functions. The first is to seal against noise between the regulating damper and the pressure distribution pipe and against other noise which may occur in the system. The second is to clean the pressure distribution duct and its perforations from, for example, dust and particles by the motion of the regulating damper to and fro inside the pressure distribution pipe.

According to a further embodiment of the invention, a delivery facility is disposed outside the plenum box and is configured to communicate with the outlet via a connecting element. The connecting element may take the form of fastening elements which fasten the delivery facility to the outlet of the plenum box. The connecting element may also take the form of, for example, a pipe section between the delivery facility and the outlet of the plenum box in order to lead the air from the plenum box to the delivery facility. This may be relevant in situations where it is not possible, e.g. for reasons of space, for the plenum box to be situated in the immediate vicinity of the delivery facility.

According to a further embodiment of the invention, the delivery facility is disposed in the outlet integrated in the plenum box. This means that the walls of the plenum box therefore surround the delivery facility.

BRIEF DESCRIPTION OF THE DRAWINGS

A preferred embodiment of the device according to the invention is described below in more detail with reference to the attached schematic drawings, which only show the parts which are necessary for understanding the invention.

DETAILED DESCRIPTION OF VARIOUS EMBODIMENTS OF THE INVENTION

Figure 1:
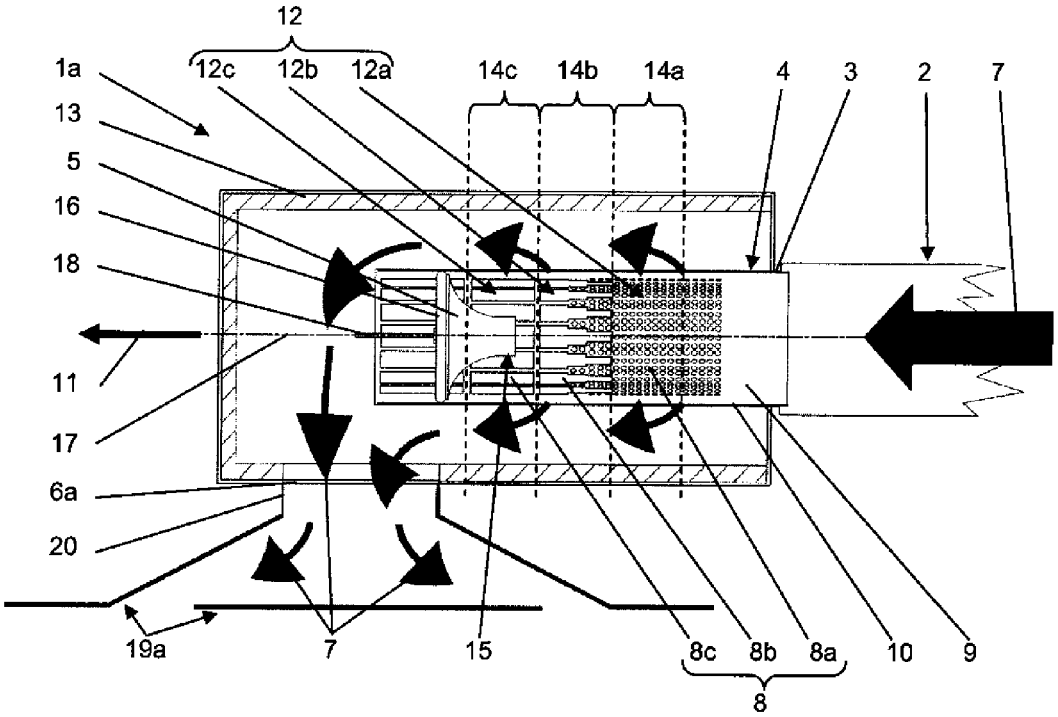
FIG. 1 depicts a section through a plenum box with an externally fitted delivery facility, which plenum box comprises a pressure distribution pipe with a regulating damper.

FIG. 1 depicts a plenum box (1*a*) configured for use in a ventilation system (2) with flowing air. The plenum box (1*a*) is configured to create a controlled flow of air through the plenum box (1*a*) so that the air in the plenum box (1*a*) becomes uniformly distributed and mixed. The ventilation system (2) extends between various units to make it possible to transfer air between them. The ventilation system (2) takes the form with advantage of pipes which connect the various units to one another. The plenum box (1*a*) comprises an inlet (3) and an outlet (6*a*). The inlet (3) has a pressure distribution pipe (4) disposed in it. The pressure distribution pipe (4) is configured both to regulate pressures in the ventilation system (2) and to regulate the volume of air in the plenum box (1*a*). The pressure distribution pipe (4) comprises and surrounds a regulating damper (5) which is disposed adjustably in the axial direction (11) inside the pressure distribution pipe (4). The pressure distribution pipe (4) extends inside the plenum box (1*a*) from the inlet (3). The pressure distribution pipe (4) is tubular and circular in shape as viewed in section through the pressure distribution pipe (4) (not depicted). The surface of the pressure distribution pipe (4) comprises perforations (8) which allow air (7) to pass through them. The air (7) flows from the ventilation system (2), in through the inlet (3) and into the pressure distribution pipe (4). The perforations (8) in the pressure distribution pipe (4) make it possible for the air flow (7) to pass through between the inside (9) and outside (10) of the pressure distribution pipe (4). The perforations (8) have a total aperture cross-section (12) per unit length of the pressure distribution pipe (4) which varies in the latter's axial direction (11).

The perforations (8) are disposed and configured on the surface of the pressure distribution pipe (4) in such a way that the total aperture cross-section per unit length increases in the axial direction (11) of the pressure distribution pipe (4) into the plenum box (1*a*) from the inlet (3).

According to an embodiment, the pressure distribution pipe (4) comprises a first section (14*a*) which itself comprises perforations (8) of a first perforation type (8*a*) with a first specific aperture cross-section. This first section (14*a*) is followed, in the axial direction (11) from the inlet (3), by a second section (14*b*) which is itself followed by a third section (14*c*). The second section (14*b*) comprises perforations of a second perforation type (8*b*) with a second specific aperture cross-section. The third section (14*c*) comprises perforations of a third perforation type (8*c*) with a third specific aperture cross-section. The first specific aperture cross-section is smaller than the second and third specific aperture cross-sections. The third specific aperture cross-section is larger than the first and second specific aperture cross-sections. Said specific aperture cross-sections for perforations (8) disposed in the pressure distribution pipe (4) constitute together for each unit length a total aperture cross-section (12) in the pressure distribution pipe (4) as viewed in its axial direction (11). The total aperture cross-section (12) for an equal unit length of each section (14*a*-14*c*) increases from the first section (14*a*), which has the smallest total aperture cross-section (12*a*), to the third section (14*c*) which has the largest total aperture cross-section (12*c*). In the first and third sections (14*a*, 14*c*), the total aperture cross-section (12*a*, 12*c*) increases in the axial direction (11) of the pressure distribution pipe (4) into the plenum box (1*a*) from the inlet (3) per unit length linearly. In the second section (14*b*) the total aperture cross-section (12*b*) increases in the axial direction (11) of the pressure distribution pipe (4) into the plenum box (1*a*) from the inlet (3) per unit length exponentially. The second section (14*b*) comprises not only perforations (8) of the second perforation type (8*b*) but also perforations (8) of the first perforation type (8*a*). The second perforation type (8*b*) is wedge-shaped, with the result that there is no step-like increase in total aperture cross-section (12) between the first and third sections, but instead an exponential increase which changes to a linear increase.

In the pressure distribution pipe (4) according to FIG. 1, the number of perforations (8) decreases in the axial direction (11) from the inlet (3) while at the same time the aperture cross-section (12) of the perforations increases per unit length in the axial direction (11) from the inlet (3).

According to an embodiment of the pressure distribution pipe (4), the perforations (8) are disposed on the side surfaces of the pressure distribution pipe (4), meaning the surfaces which face towards the walls of the plenum box (1*a*). No perforations are provided on the upper and lower surfaces of the pressure distribution pipe (4) in its axial direction (11). The upper and lower surfaces are therefore free from perforations. In the plenum box (1*a*), the pressure distribution pipe (4) is disposed centrally as viewed in the longitudinal direction of the pressure distribution pipe (4), with the result that the respective distances between the centreline (17) through the pressure distribution pipe (4) and the respective sidewalls of the plenum box (1*a*) which are disposed parallel to the centreline (17) are equal. The fact that the pressure distribution pipe (4) has perforations (8) disposed on the side surfaces, with air flowing out from them, and is disposed centrally in the plenum box (1*a*) results in uniform distribution of air flow above and below in the delivery facility. The uniform distribution is due to the fact that the same amount of air flows out from each side of the pressure distribution pipe (4) and at the same velocity. The air thus acquires a swirling motion inside the plenum box (1*a*) and on each side of the pressure distribution pipe (4) inside the plenum box (1*a*). The result is that the air from the pressure distribution pipe (4) is thus distributed and mixed uniformly inside the plenum box (1*a*). The fact that the air flow becomes uniform above and below in the delivery facility results in uniform distribution of air out from the delivery facility into the room.

According to an embodiment, the regulating damper (5) is cone-shaped and, as mentioned above, is disposed adjustably in the axial direction (11) inside the pressure distribution pipe (4). The regulating damper (5) comprises a narrowed end (15) and a base portion (16), whereby the narrowing end (15) constitutes a tip of the cone-shaped regulating damper (5). The cone-shaped portion of the regulating damper (5) which leads to the narrowing end (15), as viewed in section according to FIG. 1, has from the outside diameter of the base portion a concave-like region with an external radius. At the extremity of the narrowing end (15) there is an edge portion which defines said tip of the cone-shaped regulating damper (5). This edge portion is circular and extends round the tip of the narrowing end (15). As viewed in section according to FIG. 1, said edge portion may have a convex-like region with an internal radius. The edge portion with internal radius is not depicted in the drawing but only appears in section as an edge. The relationship between the external radius and the internal radius is such that the external radius is larger than internal radius. The narrowing end (15) of the regulating damper points in the axial direction, along a centreline (17) through the pressure distribution pipe (4), towards the inlet (3). The shape of the base portion (16) is such that for a given unit length of the pressure distribution pipe (4) in the latter's axial direction (11) the base portion (16) abuts against the whole inside (9) for that given unit length. According to this embodiment, the base portion (16) has a diameter which allows the regulating damper (5) with a certain friction to move in the axial direction (11) inside the pressure distribution pipe (4). Owing to the conical shape of the regulating damper (5), the regulating damper (5) directs an incoming air flow (7) from the ventilation system (2) into the pressure distribution pipe (4) towards the inside (9) of the pressure distribution pipe (4), whereby the air flow (7) is allowed to pass through the perforations (8) to the outside (10) of the pressure distribution pipe (4) and into the plenum box (1*a*). The base portion (16) of the regulating damper (5) is disposed against a regulating means (18) which cooperates with an element (not depicted) which is configured for regulating the position of the regulating damper (5) inside the pressure distribution pipe (4). When the regulating damper (5) is moved towards the inlet (3), the total aperture cross-section (12) of the pressure distribution pipe (4) for ingress of air into the plenum box (1*b*) is reduced. The pressure inside the ventilation system (2) is thus increased, making it possible for the air flow inside the ventilation system (2) to be directed to other units of the ventilation system (2). Conversely, when the regulating damper (5) is instead moved away from the inlet (3), the total aperture cross-section (12) of the pressure distribution pipe (4) increases. The fact that the total aperture cross-section (12) per unit length can be increased both linearly and exponentially makes it possible by small changes in the movement of the regulating damper (5) to quickly increase the air inflow (7) into the plenum box (1*a*) for further outflow into the room or space.

A delivery facility (19*a*) is disposed at the outlet (6*a*) of the plenum box (1*a*). The delivery facility (19*a*) is configured to spread and distribute flowing air into a room or space. The delivery facility (19*a*) and the plenum box (1*a*) and the associated ventilation system (2) are traditionally disposed in an intermediate ceiling of the room or space. The delivery facility (19*a*) may be connected to the ceiling in way of the room or space via an aperture or recess in the ceiling (not depicted). Air can therefore flow into the room or space from the delivery facility (19*a*) via this aperture in the ceiling. Alternatively, the ventilation system (2) may also be disposed, along with the plenum box (1*a*) and the delivery facility (19*a*), in a wall or floor. According to a configuration, the ventilation system (2) may be disposed, along with the plenum box (1*a*) and the delivery facility (19*a*), directly in a ceiling of a room or space and not inside a so-called intermediate ceiling (not depicted). In that case the outflow of air from the ventilation system passes directly into the room or space from the delivery facility (19*a*). This is usual practice in, for example, buildings configured for use as, for example, storage premises.

Figure 2:
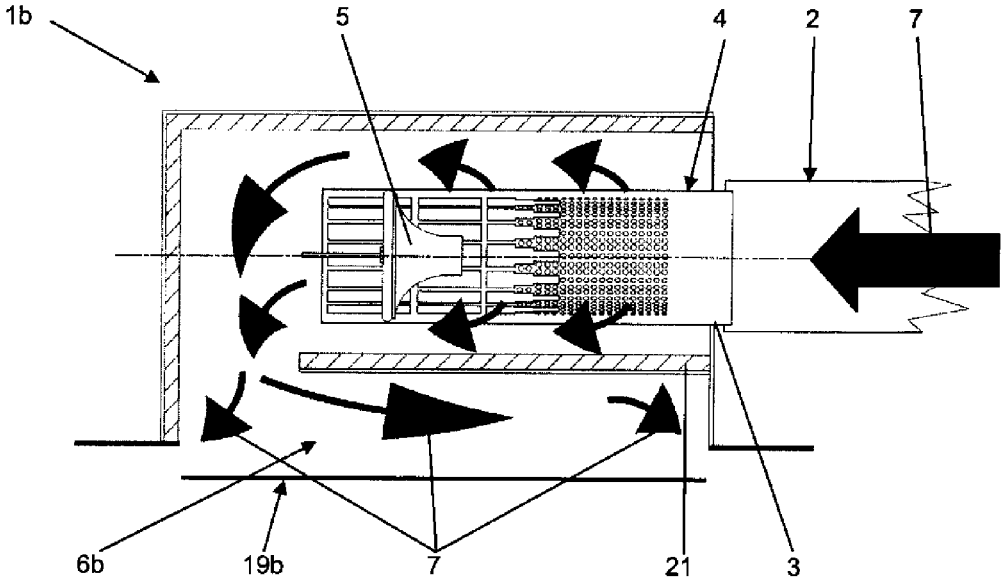
FIG. 2 depicts a variant in section through a plenum box with an integrated delivery facility, which variant comprises a pressure distribution pipe with a regulating damper according to FIG. 1.

FIG. 2 depicts a variant of a plenum box (1*b*) comprising a pressure distribution pipe (4) according to the pressure distribution pipe in FIG. 1, and a delivery facility (19*b*) which is integrated in the outlet (6*b*) of the plenum box (1*b*). For detailed information on the pressure distribution pipe (4) and the regulating damper (5) in FIG. 2, see the above text relating to FIG. 1, since the pressure distribution pipe (4) and the regulating damper (5) in FIG. 2 correspond to the previously described pressure distribution pipe (4) and regulating damper (5) in FIG. 1. The plenum box (1*b*) is provided on the inside with a tongue (21) which extends from the wall of the plenum box (1*b*) and its associated inlet (3). This tongue (21) extends below the pressure distribution pipe (4) inside the plenum box (1*b*) for approximately the same distance as that by which the pressure distribution pipe (4) extends inside the plenum box (1*b*) from the inlet (3). The tongue (21) has a free end disposed at the opposite side from the end which is adjacent to said wall with the inlet (3). A passage is provided between this free end and the wall of the plenum box (1*b*) which is opposite to the wall with the inlet (3). This passage is configured to lead the air flow (7) which comes out from the perforations (8) of the pressure distribution pipe (4) down towards the outlet (6*b*) and to the integrated delivery facility (19*b*). The delivery facility (19*b*) is depicted in FIG. 2 with a portion disposed at a distance below the pressure distribution pipe, thereby allowing air (7) flowing out from the plenum box (1*b*) to spread out sideways from the delivery facility (19*b*) into the room. The plenum box (1*b*) has its wall element connected to the ceiling in way of the room or space (not depicted). The ceiling under the connected plenum box (1*b*) is provided with a recess in which the integrated delivery facility (19*b*) is positioned. Alternatively, the delivery facility (19*b*) may be suspended directly in a ceiling or false ceiling so that the air flows directly out into the room from the plenum box (1*b*) and the delivery facility (19*b*).

The plenum box (1*a*, 1*b*) as above is internally insulated by an insulant (13). The insulant (13) reduces the generation of noise from the plenum box (1*a*, 1*b*) which may arise from the throughflow of air. Noise occurring in the ventilation system (2) or in the space where the plenum box is situated will be reduced by the insulant (13) in the plenum box (1*a*, 1*b*), thereby limiting the spread of noise to other units in the ventilation system (2). The possibility of noise spreading between two rooms via the ventilation system (2) in cases where each of the rooms is provided with an insulated plenum box (1*a*, 1*b*) is thus avoided or reduced.

The invention is not limited to the embodiment referred to but may be varied and modified within the scope of the claims set out below, as partly described above.

The invention claimed is:

1. A plenum box configured for use in a ventilation system with flowing air, which plenum box comprises a pressure distribution pipe which is disposed in an inlet to the plenum box, and an outlet, whereby the inlet is configured for an air flow to pass through it, the pressure distribution pipe extending inside the plenum box from the inlet and having an axial direction, a regulating damper, a first section, and a second section, wherein a surface of the pressure distribution pipe has perforations which allow the air flow to pass through them between an inside and an outside of the pressure distribution pipe wherein a total aperture cross-section of the perforations per unit length in the first section is different relative to a total aperture cross-section of the perforations per unit length in the second section as viewed in the axial direction and the regulating damper is disposed adjustably in the axial direction inside the pressure distribution pipe and is configured to angle an incoming air flow from the ventilation system towards the perforations, wherein a displacement in the axial direction of a position of the regulating damper from the first section to the second section is arranged to alter the air flow through the pressure distribution pipe non-linearly.

2. A plenum box according to claim 1, in which the perforations are disposed in the surface of the pressure distribution pipe in such a way that their total aperture cross-section increases in the axial direction into the plenum box from the inlet.

3. A plenum box according to claim 1, in which the number of perforations in the surface of the pressure distribution pipe increases into the plenum box in the axial direction from the inlet.

4. A plenum box according to claim 1, in which some of the perforations take the form of a first perforation type with a first aperture cross-section and some take the form of a second perforation type with a second aperture cross-section.

5. A plenum box according to claim 4, comprising a third perforation type with a third aperture cross-section, which third aperture cross-section differs from both the first and the second aperture cross-section.

6. A plenum box according to claim 1, in which perforations of the first perforation type are disposed in a first section, perforations of the second perforation type are disposed in a second section and perforations of the third perforation type are disposed in a third section, the first and third sections being each disposed on their respective side of the second section in the axial direction along the pressure distribution pipe.

7. A plenum box according to claim 6, in which the first section is arranged closer to the inlet than the second and third sections in the axial direction along the pressure distribution pipe into the plenum box from the inlet.

8. A plenum box according to claim 6, in which the first section for a unit length has a total aperture cross-section which is smaller than a total aperture cross-section for a corresponding unit length for the second section.

9. A plenum box according to claim 7, in which the third section has a total aperture cross-section for a unit length which is larger than the total aperture cross-section for a corresponding unit length of the first section and of the second section.

10. A plenum box according to claim 6, in which the total aperture cross-section in the first section increases linearly in the axial direction along the pressure distribution pipe into the plenum box from the inlet.

11. A plenum box according to claim 6, in which the total aperture cross-section in the second section increases exponentially in the axial direction along the pressure distribution pipe into the plenum box from the inlet.

12. A plenum box according to claim 7, in which the total aperture cross-section in the third section increases linearly in the axial direction along the pressure distribution pipe into the plenum box from the inlet.

13. A plenum box according to claim 1, in which the regulating damper is cone-shaped with a narrowed end and is disposed in the pressure distribution pipe with its narrowed end pointing along the centreline through the pressure distribution pipe out from the plenum box through the inlet.

14. A plenum box according to claim 1, in which the regulating damper is connected by a regulating element against a rear portion of the regulating damper to a regulating means for the plenum box which is configured to regulate the position of the regulating damper in the axial direction inside the pressure distribution pipe.

15. A plenum box according to claim 14, in which the regulating means is a motor, preferably an actuator, configured to regulate in a continuous movement the position of the regulating damper in the axial direction inside the pressure distribution pipe.

16. A plenum box according to claim 1, in which the regulating damper is configured in the pressure distribution pipe in such a way that when the regulating damper is in position at the inlet the inlet is closed, resulting in no air flow into the pressure distribution pipe from the ventilation system.

17. A plenum box according to claim 1, in which a delivery facility is disposed outside the plenum box and is configured to communicate with the outlet via a connecting element.

18. A plenum box according to claim 1, in which a delivery facility is disposed in the outlet integrated in the plenum box.

19. A plenum box for use in a ventilation system, the plenum box comprising:

an inlet configured for air flow therethrough;

an outlet; and a pressure distribution pipe extending into the plenum box from the inlet, the pressure distribution pipe having a first section with perforations and a second section with perforations, a total aperture cross-section of the perforations per unit length in the first section being different than a total aperture cross-section of the perforations per unit length in the second section as viewed in an axial direction of the pressure distribution pipe; and a regulating damper disposed within the pressure distribution pipe, the regulating damper being movable in the axial direction relative to the pressure distribution pipe, the regulating damper being configured to angle incoming air flow from the ventilation system towards the perforations of at least one of the first and second sections, the regulating damper non-linearly chancing the air flow through the pressure distribution pipe when the regulating damper moves in the axial direction from the first section to the second section.

* * * * *